US005172504A

United States Patent [19]

De Maat et al.

[11] Patent Number: 5,172,504

[45] Date of Patent: Dec. 22, 1992

[54] FRONT-MOUNT GRID DISPLAY HAVING TRIM STRIPS AND HOOK AND LOOP

[75] Inventors: H. Thomas De Maat, Holland; H. Jay Schoeppe, II, Hudsonville, both of Mich.

[73] Assignee: Grid-Graphics Services Corporation, Grand Rapids, Mich.

[21] Appl. No.: 652,800

[22] Filed: Feb. 8, 1991

[51] Int. Cl.[5] ..... G09F 7/00

[52] U.S. Cl. ..... 40/605; 49/465; 52/DIG. 13; 52/764; 40/156

[58] Field of Search ..... 40/152, 611, 152.1, 40/154, 155, 156, 617, 618, 620, 308, 649, 308, 158.1, 574, 575; 211/40, 71, 88; 403/406.1, 408.1, 409.1, 405.1, 295, 381; 248/488, 220.3, 224.1, 224.2, 205.2; 49/465; 160/354, 369; 312/185; 24/306; 52/202, 203, 764, 774–776, 716, 717.1, DIG. 13

[56] References Cited

U.S. PATENT DOCUMENTS

| | | | |
|---|---|---|---|
| 433,107 | 7/1890 | Tollner | 40/154 |
| 2,092,508 | 9/1937 | Hammar | 40/620 |
| 2,218,409 | 10/1940 | Smalls . | |
| 2,880,537 | 4/1959 | Cygan | 40/620 |
| 2,914,872 | 12/1959 | Goodrich . | |
| 2,940,606 | 6/1960 | Kurnitz . | |
| 3,237,333 | 3/1966 | Bacharach | 40/156 |
| 3,445,151 | 5/1969 | Stefanakis | 40/156 |
| 3,523,382 | 8/1970 | Dreyer . | |
| 3,648,393 | 3/1972 | Parrilla . | |
| 3,668,808 | 6/1972 | Perina | 49/465 |
| 3,721,050 | 3/1973 | Perina | 52/764 X |
| 3,793,757 | 2/1974 | Jaquillard | 40/620 |
| 3,971,178 | 7/1976 | Mazzoni et al. | 52/203 X |
| 4,034,496 | 7/1977 | Cohen . | |
| 4,043,477 | 8/1977 | Deese . | |
| 4,050,498 | 9/1977 | Lucchetti . | |
| 4,115,938 | 9/1978 | Belmuth et al. . | |
| 4,145,827 | 3/1979 | Katsufrakis . | |
| 4,209,922 | 7/1980 | Porreca . | |
| 4,271,566 | 6/1981 | Perina | 403/405.1 X |
| 4,271,619 | 6/1981 | Schmidt | 40/154 |
| 4,348,826 | 9/1982 | Reim . | |
| 4,349,974 | 9/1982 | Rapayelian . | |
| 4,356,648 | 11/1982 | Beaulieu | 40/152 X |
| 4,368,584 | 1/1983 | Logan . | |
| 4,385,459 | 5/1983 | McGrath et al. . | |
| 4,399,625 | 8/1983 | Langan | 40/152.1 X |
| 4,497,125 | 2/1985 | Hutchinson . | |
| 4,532,727 | 8/1985 | Klose et al. . | |
| 4,608,770 | 9/1986 | Gray . | |
| 4,656,766 | 4/1987 | Cooper | 40/611 X |
| 4,669,209 | 6/1987 | Pollack . | |
| 4,706,397 | 11/1987 | Hesener . | |
| 4,760,681 | 8/1988 | Harrison | 52/716 |
| 4,765,077 | 8/1988 | Rosenthal et al. | 40/308 |
| 4,773,175 | 9/1988 | Larsen | 40/308 |
| 4,940,147 | 7/1990 | Hunt | 211/71 X |
| 4,964,231 | 10/1990 | De Maat et al. . | |

FOREIGN PATENT DOCUMENTS

| | | | |
|---|---|---|---|
| 299136 | 5/1954 | Switzerland | 40/620 |
| 2211011 | 6/1989 | United Kingdom | 40/605 |
| 8607271 | 12/1986 | World Int. Prop. O. | 40/621 |

*Primary Examiner*—Kenneth J. Dorner
*Assistant Examiner*—James M. Gardner
*Attorney, Agent, or Firm*—Warner, Norcross & Judd

[57] ABSTRACT

An improved front-mount grid display having preassembled display panels with trim strips adhered to the edges of the display panel boards. The trim strips protect the edges of the board, and have lips overlying the perimeters of the front faces of the boards to present a neat and finished appearance. The trim strips are adhered to the board edges by double-sided adhesive tape. The trip strips may have rear flanges overlying the perimeter of the rear faces of the board, and the display panels may include transparent panes. Also disclosed is a grid display construction in which two grid displays are arranged back-to-back with one or more sign panels extending outwardly from the grid displays and having portions entrapped and supported between the grid displays.

4 Claims, 4 Drawing Sheets

FRONT-MOUNT GRID DISPLAY HAVING TRIM STRIPS AND HOOK AND LOOP

BACKGROUND OF THE INVENTION

1. Field of the Invention

The present invention relates to grid displays, and in particular to an improved modular system for assembling frontmount grid displays and to a construction of grid displays with auxiliary display signs.

2. Description of the Related Art

Grid displays have gained increasing popularity for use in restaurants, lobbies, etc. Essentially, grid displays of the prior art have included wall-mounted units employed to present a plurality of pictures in juxtaposition to form an array of pictures mounted within a common peripheral frame. Typically, grid displays have been comprised of a plurality of self-contained individual frame units coupled together to form a series of picture-containing openings.

U.S. Pat. No. 4,964,231, issued Oct. 23, 1990, discloses a modular grid display comprised of a small inventory of parts and provided to enable the secure and variable mounting of an array of display inserts within a common peripheral frame. The grid display includes frame members which may be cut to the desired length and mounted and oriented into a grid pattern with specially designed connector elements. Display insert panels are placed in the openings of the grid frame and held in place by retaining strips inserted between panel edges and the frame members after the panels are in place, or by hook and loop fabric fasteners which attach the rear surfaces of the panels to surfaces of the frame or connector elements.

It may frequently be desired to change the signage on the panels carried on a grid display frame. Since grid displays are frequently mounted in difficult to reach locations such as high on walls above merchandise display cabinets, it is important that the panels be easily installed and removed. Most advantageously, the panels should be installable and removable from the front, and the procedure should not damage the panels.

While grid displays of the prior art are often installed on wall surfaces, other locations may be desired. Supermarkets usually have signage suspended above the ends of aisles indicating the types of merchandise in the aisle. Such aisle directory signs provide excellent locations for the display of additional advertising or informational signage.

Accordingly, there is a need for a grid display that is completely front-mounted, which allows for easy installation and removal of signage display panels, which presents an attractive and pleasing appearance, and which is suitable for use in cooperation with other display elements such as aisle directory signs.

SUMMARY OF THE INVENTION

The present invention satisfies the aforementioned needs by providing an improved front-mount grid display in which, in one aspect of the invention, display panels have their peripheral edges surrounded by trim strips assembled to the panels before the panel is placed in the frame. The trim strips have forward lips that extend around the edges of the panels and over the perimeter of the front panel surface, thereby concealing the panel edges and providing an attractive and finished appearance. The trim strips are held in assembled relationship by adhesion to the panel edges, preferably by lengths of double-sided foam adhesive tape disposed between the panel edges and the trim strips.

In one embodiment, the trim strips have rear flanges which extend over the perimeter of the rear panel surface. In another, there is no rear flange. The trim strips may be used in assembly with a display panel board alone, or with a panel board and a transparent pane. In either embodiment, the assembled panel and trim strips are placed into a grid frame opening as a unit. Preferably, hook and loop fasteners are adhered to the front surfaces of the grid frame connectors and to the rear surface of the panel so that the panel is held in place without the need for additional retaining devices.

The trim strips further protect the edges of the panel so that, if necessary, when the panels are removed by the use of a prying tool, the tool will not damage the edges of the panel.

According to an additional feature of the invention, a clip is provided for attaching the grid display frame assembly to wire mesh display.

According to an additional feature of the invention, two grid display frame assemblies are used in conjunction with one or more sign panels extending outwardly from the edges of the grid display frame assemblies. The two grid display assemblies are disposed back-to-back, and the sign panels are provided with lugs which extend inwardly between the rear faces of the grid frames. Fasteners are used to hold the two grid frames together and to entrap the lugs therebetween. The sign panels, which are particularly well suited for use as store aisle directories, may be wire mesh panels.

These and other objects, advantages, and features of the present invention will be more fully understood and appreciated by reference to the written specification and appended drawings.

DESCRIPTION OF THE PREFERRED EMBODIMENT

Figure 1:
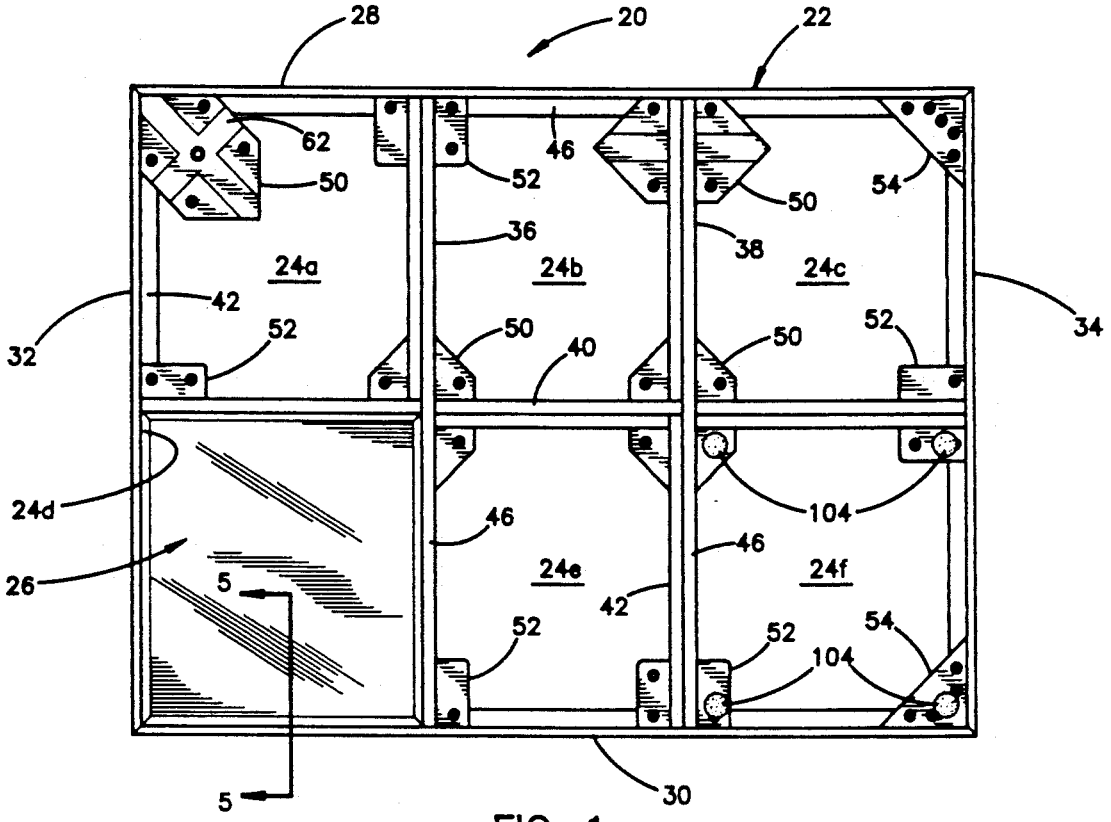
FIG. 1 is a front elevational view of a front-mount grid display according to the principles of the invention having a single display panel assembly installed.

By way of disclosing a preferred embodiment, and not by way of limitation, there is shown in FIG. 1 a front-mount grid display 20 which includes in its general organization a grid frame 22 defining six rectangular grid openings 24*a*–24*f* and a display panel 26 installed in opening 24*d*. Although FIG. 1 shows only a single display panel 26 installed, it is to be understood that a fully assembled grid display 20 will have a display panel 26 installed in each of the grid openings 24*a*–24*f*. It should also be understood that the present invention is not limited to a grid display having six rectangular openings. Other numbers and shapes of grid openings come within the scope of the invention as will be appreciated by those with skill in the art.

The grid frame 22 is constructed substantially in accordance with the above-mentioned U.S. Pat. No. 4,964,231, which is incorporated herein by reference. In its general arrangement, the grid frame 22 includes a number of elongated frame members including top, bottom, left, and right outer frame members 28, 30, 32, and 34, respectively, which are joined together at their mutually adjacent ends to form a rectangular outer peripheral frame. The grid frame 22 further includes interior frame members including vertical interior frame members 36 and 38, and horizontal interior frame member 40. Together, the interior frame members divide the area surrounded by the outer peripheral frame into the six grid openings 24*a*–24*f*.

Figure 5:
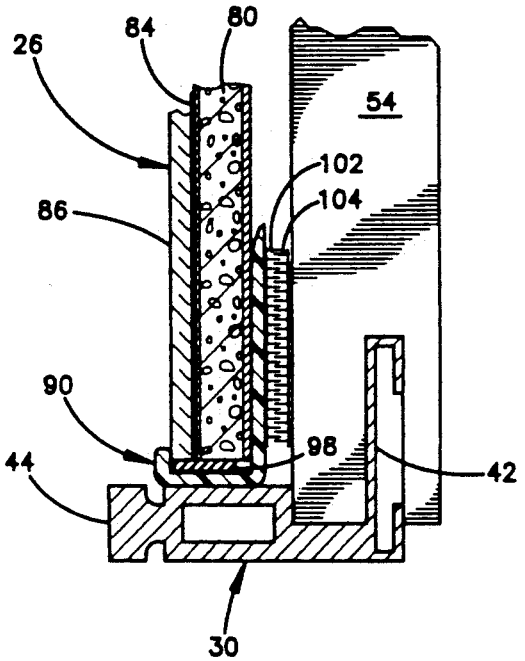
FIG. 5 is an enlarged sectional view taken along the line 5—5 of FIG. 1.

Referring additionally to FIG. 5, it may be seen that, in accordance with the teachings of U.S. Pat. No. 4,964,231, each of the outer and interior frame members is configured with a generally L-shaped cross-section, having a base 42 disposed generally in a plane defining a rear face of the grid display, and a forwardly extending leg 44. The frame members are preferably made of extruded plastic or aluminum material.

Referring again to FIG. 1, at each intersection or junction of the frame members, the frame members are aligned and held together by frame connectors including hexagonal connectors 50, rectangular tee connectors 52, and triangular corner connectors 54. The hexagonal connectors are constructed according to U.S. Pat. No. 4,964,231.

Figure 8:
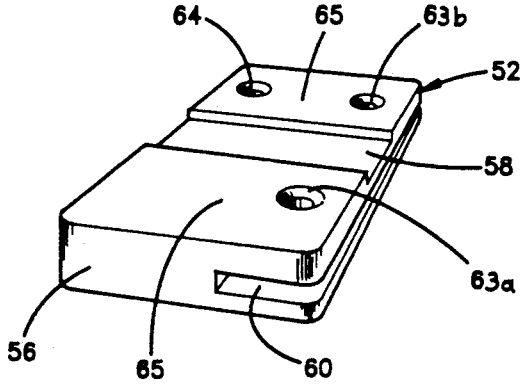
FIG. 8 is a front and side perspective view of a rectangular frame tee connector.

The rectangular connectors 52, shown in detail in FIG. 8, are specially adapted for use at tee junctions of frame members. In a manner similar to the hexagonal connectors, each rectangular connector includes a body 56 having a shallow channel 58 formed on the front face of the body and a groove 60 formed along one edge of the body disposed perpendicular to the channel 58. The groove 60 is provided to receive the base member 42 of an outer frame member, and the channel 58 is provided to receive the rear extent of the base member 42 of an inner frame member in the same manner as the channels 62 (FIG. 1) of a hexagonal connector. The rectangular connectors 52 are further provided with three countersunk holes 63*a*, 63*b*, 64. Holes 63*a*, 63*b* are disposed over the groove 60 and are provided to receive screws for fixing the connector to the base extending through the groove. Hole 64 is provided to receive fasteners such as screws which pass completely through the connector and attach the grid display to a supporting structure such as a wall. Hole 64 may also be used for a fastener used to hold a display sign extending outwardly from the grid frame, or to hold two grid frames in back-to-back facing relationship with one or more display signs entrapped between the two frames as described below with respect to FIG. 11–14. On either side of the channel 58, the connector is formed with two pad surfaces 65.

Figure 7:
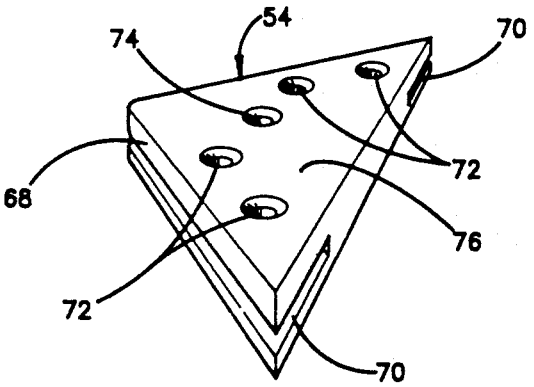
FIG. 7 is a front and side perspective view of a triangular frame corner connector.

The triangular corner connectors 54, shown in FIG. 7, each include a body 68 formed as a right isosceles triangle with grooves 70 formed in the shorter edges. These grooves receive the bases 42 of adjacent outer frame members at corners of the frame. There are five countersunk holes 72, 74 provided. Holes 72 receive screws fixing the connector to the frame member bases received in the grooves 70. Hole 74 is provided to receive fasteners such as screws which pass completely through the connector and attach the grid display to a supporting structure such as a wall. Hole 74 may also be used for a fastener used to hold a display sign extending outwardly from the grid frame, or to hold two grid frames in back-to-back facing relationship with one or more display signs entrapped between the two frames as described below with respect to FIG. 11–14. The front face of the connector 54 forms a pad surface 76.

FIG. 1 shows a grid frame display using a variety of hexagonal, rectangular, and triangular connectors, and is intended to show various possibilities for constructing such a frame. It is to be understood that various other combinations and orientations of the connectors may be used.

Figure 2:
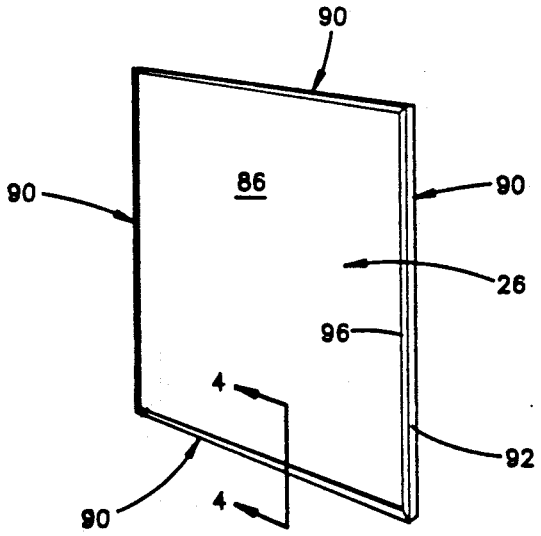
FIG. 2 is a front perspective view of a display panel assembly.
Figure 3:
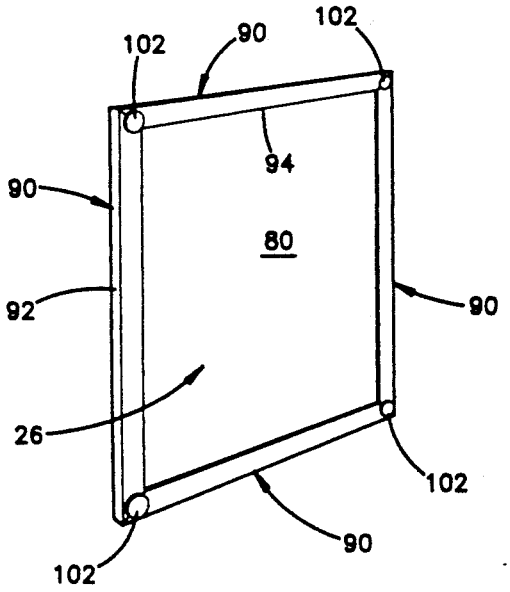
FIG. 3 is a rear perspective view of a display panel assembly.
Figure 4:
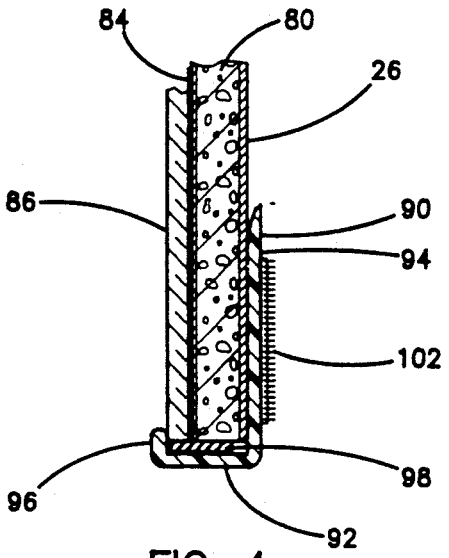
FIG. 4 is an enlarged sectional view taken along the line 4—4 of FIG. 2.

FIGS. 2–4 show the construction of a display panel. Each panel includes a foam core board 80, a transparent pane 86 coextensively overlying the front face of the board 80, and a printed poster or sheet 84 lying between the board and the pane. Alternatively, the sheet 84 may be omitted in which case printing may be provided directly on the board face. The board 80 is rectangular and of dimensions somewhat smaller that the opening of the grid frame into which the board will be installed.

On each of the four outer edges of the board there is provided a trim strip 90. As best shown in FIG. 4, each trim strip 90 is substantially J-shaped in cross section, having an outer leg 92 disposed substantially normal to the plane of the face of the panel 26, a rear flange 94 extending from the rear extent of the outer leg inwardly and overlying the outer perimeter of the rear face of the board 80, and a front lip 96 extending inwardly from the forward extent of the outer leg and overlying the perimeter of the front face of the pan 86. At the corners of the panel, the trim strips 90 are mitered.

A channel is formed in each trim strip 90 along the inner surface of the outer leg 92 between the lip 96 and the flange 94. The width of this channel is selected so as to receive the edges of the board 80, sheet 84, and pane 86 and to hold them in assembled relationship. The trim strips 90 are secured to the edges of the panel by suitable adhesive means, such as double-sided foam adhesive tape 98. On the rear of the display panels near the corners, hook and loop fabric fastener elements 102 are adhered.

The display panels 26 are preassembled before installation in the grid frame openings. For each panel, a board 80 and pane 86 are cut to size. The pane is laid on the front face of the panel with a printed sheet under the pane, if desired. Trim strips 90, preferably made of extruded plastic material, are cut to length, and lengths of double-sided foam adhesive tape 98 are adhered to the trim strips along the inner surfaces of the legs 92. The trim strips are then adhered to the edges of the boards and panes, thus capturing the outer edges of the boards and panes between the trim strip lips 96 and flanges 94. The trim strip lips 96 conceal the outer edges of the front of the pane and board so as to present a neat and finished appearance. The trim strips protect the edges of the pane and board from damage during installation into and removal from the grid frame.

As shown in FIG. 1, hook and loop fabric fastener elements 104 are adhered to the pad surfaces of the connectors 50, 52, and 54, which lie within the grid opening into which the display panel will be installed. The fastener elements 104 are thus disposed in the corners of the grid openings at locations corresponding to the fastener elements 102 on the rear corners of the display panels. As best shown in FIG. 5, the display panels are releasably held in place in the grid openings by the cooperation of the hook and loop fastener elements 102 and 104.

Still referring to FIG. 5, it may be seen that, when the display panel 26 is installed, the outer surfaces of the legs of the trim strips are disposed adjacent the legs 44 of the grid frame members such as frame member 30. The dimensions of the perimeter of the display panel are preferably slightly smaller than those of the corresponding grid opening. However, the double-sided foam adhesive tape 98 imports a degree of resiliency to the perimeter of the display panel allowing for a snug fit of the display panel in the grid opening.

Figure 6:
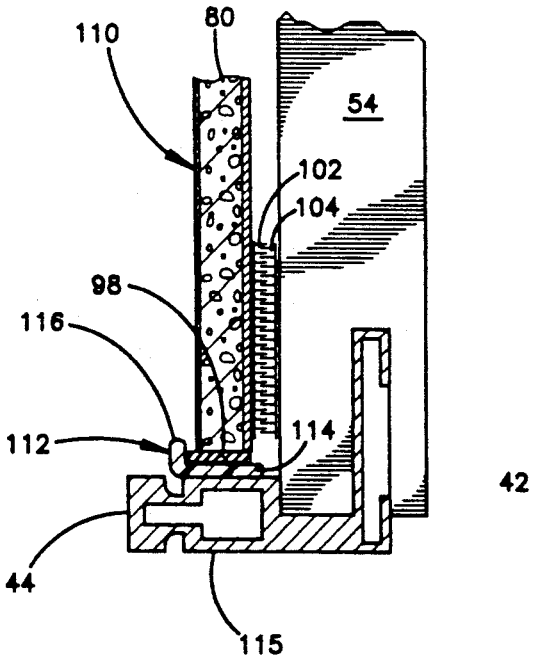
FIG. 6 is similar to FIG. 5 but showing an alternate embodiment.

An alternate embodiment is shown in FIG. 6 in which a display panel 110 does not have a transparent pane or a printed sheet. An L-shaped trim strip similar to the strip 90 of FIG. 4 may be used with such a construction with the width of the leg 92 appropriately dimensioned to correspond to the thickness of the board 80. However, FIG. 6 further depicts an alternate embodiment of the trim strip 112 having an outer leg 114 and a front lip 116 but lacking a rear flange. The trim strip 112 is adhered to the outer edge of the board 80 by double-sided foam adhesive tape 98 in a manner similar to that described above. The panel is held in place in a grid opening by hook and loop fabric elements 102, 104. In this embodiment the leg 115 of the frame member is shortened as compared to the leg 44 of FIG. 5 in correspondence with the reduced thickness of the display panel 110.

Figure 9:
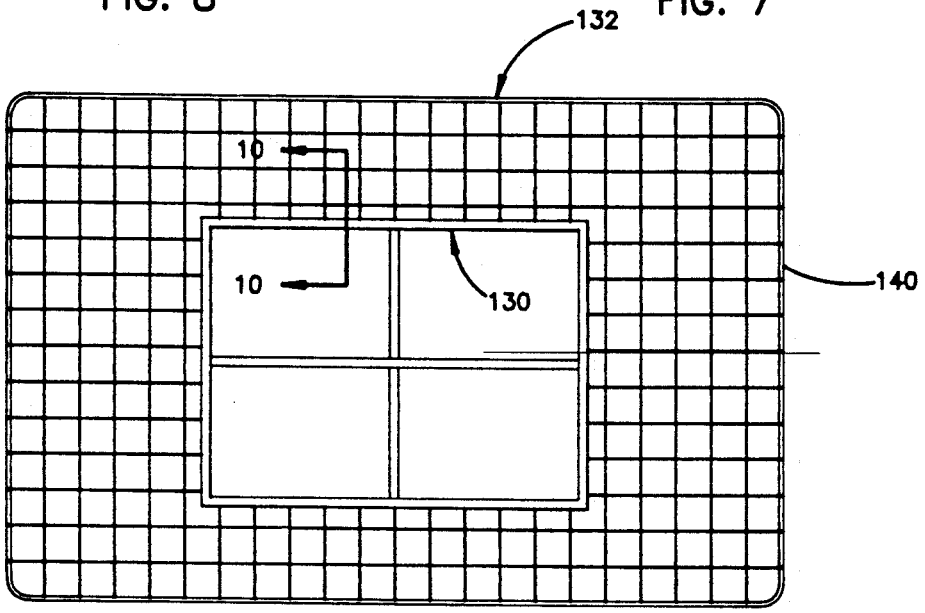
FIG. 9 is a front elevational view of a grid frame display mounted on a wire mesh panel.
Figure 10:
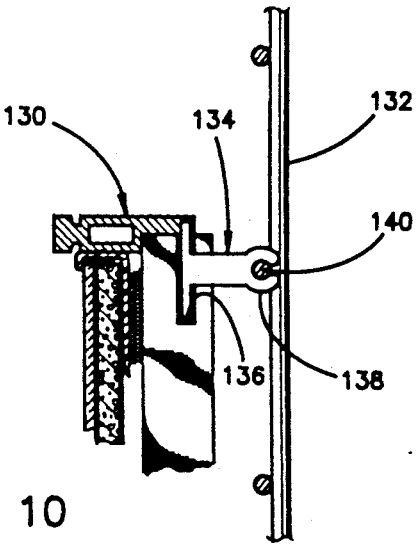
FIG. 10 is a sectional view taken along the line 10—10 of FIG. 9.

As shown in FIG. 9, a front-mount grid display frame 130 according to the invention may be used mounted to a sign panel such as a wire mesh panel 132. The mesh panel may carry other signage or decorations, while the grid display frame carries display panels as described above. The grid display frame is attached to the mesh panel by any suitable means. As shown in FIG. 10, clips 134 may be used which are received in slotted channels 136 in the rear of the frame element bases. The clips have bifurcated ends 138 which snap onto the wires 140 of the mesh panel.

Figure 14:
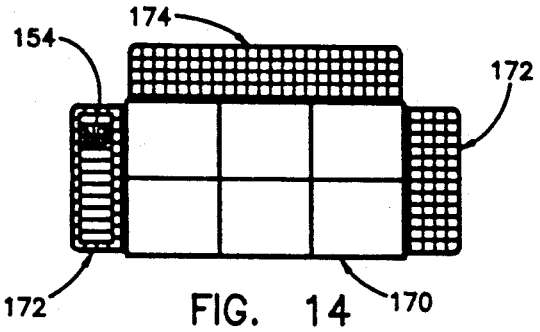
FIG. 14 is a front elevational view of an additional embodiment of an assembly of a pair of grid display frames with outwardly extending wire mesh panels.
Figure 11:
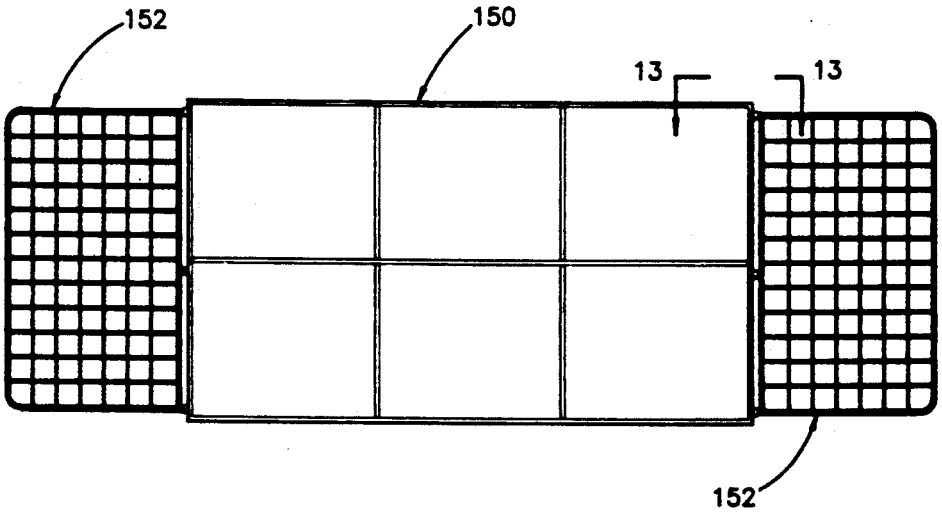
FIG. 11 is a front elevational view of an assembly of a pair of front-mount grid display frames with outwardly extending wire mesh panels.
Figure 12:
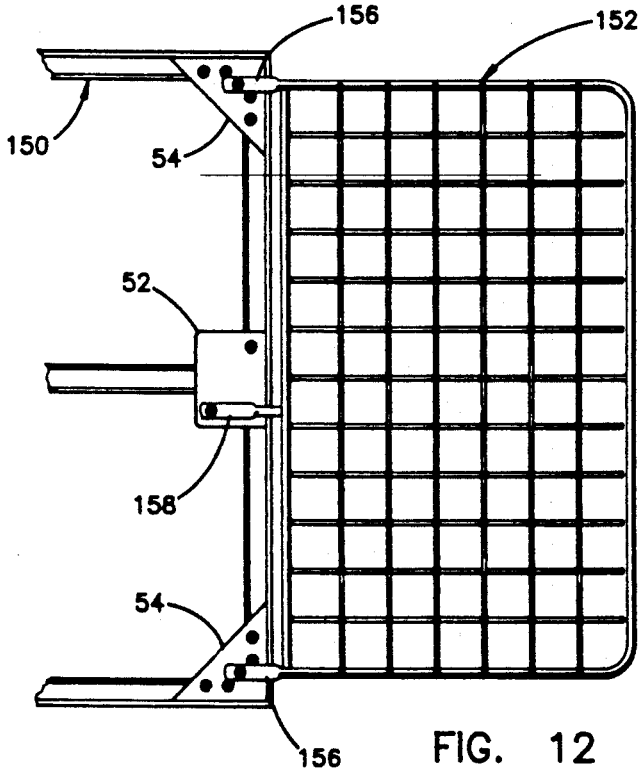
FIG. 12 is a fragmentary elevational view of one end of the assembly of FIG. 11 with one grid display frame removed.
Figure 13:
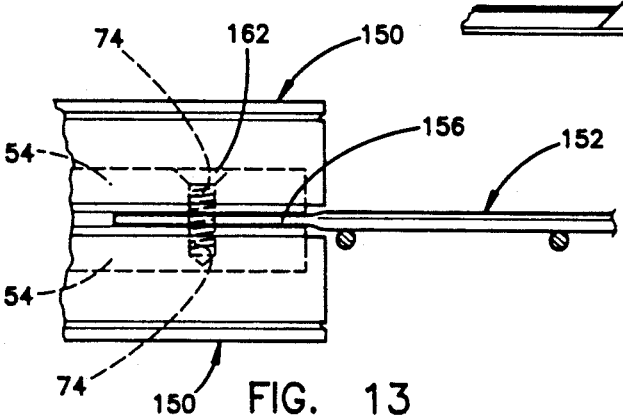
FIG. 13 is a fragmentary top view taken along the line 13—13 of FIG. 11.

FIGS. 11–13 show a further aspect of the invention in which a pair of front-mount grid displays 150 are used in conjunction with sign panels 152 extending outwardly from the edges of the grid displays. The sign panels 152 may be wire mesh panels as shown in the drawings, or any other suitable of display sign. Such a construction is particularly well suited for use as a store aisle directory. The grid display may carry panels having product advertising or decorative indicia, while the mesh panels may carry aisle directory indicia such as shown in FIG. 14 at 154.

The portions of the sign panels 152 adjacent the grid displays are provided with lugs 156, 158. The lugs extend inwardly within the perimeter of the back-to-back grid displays 150 and are entrapped between the rear faces of the grid displays. The top and bottom lugs 156 are disposed adjacent the triangular corner connectors 54, while the intermediate lug 158 is disposed adjacent the rectangular tee connector 52. Each lug is formed with a hole which is aligned with a corresponding hole in the adjacent connector. As shown in FIG. 13, the holes 74 of the corner connectors 54 of the two grid displays are co-aligned with the hole in the lug 156. The entire assembly is held together by suitable fasteners such as screws 162 inserted through the co-aligned connector and lug holes.

It will be apparent to those skilled in the art that many other approaches are possible for assembling the two grid displays in back-to-back relation with the sign panel having portions thereof entrapped between the rear faces of the grid displays. For example, the lugs 156 may be attached to frame members of the grid frame or screwed to the bodies of the grid frame connectors by self-tapping screws. Rather than having lugs, the sign panels may have continuous edge portions held between the grid displays by clamping force.

Other arrangements of sign panels are possible. As shown in FIG. 14, a pair of back-to-back grid displays 170 may be combined with three sign panels, including side wire mesh panels 172 and top wire mesh panel 174. The sign panels need not be rectangular.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A front-mount grid display comprising:

a grid frame including a plurality of frame members joined in assembled relationship to define a plurality of grid openings, each frame member having a rearward base disposed generally in a plane defining the rear of the grid display and a forwardly extending leg;

a plurality of frame connectors disposed at the intersections and junctures of said frame members having means for engaging the bases of adjacent frame members and holding said frame members in assembled relationship, each of said frame connectors having a forwardly directed pad surface extending inwardly beyond said bases into the grid opening defined by said adjacent frame members;

a plurality of hook or loop fabric fastener elements each adhered to one of said frame connector pad surfaces; and a plurality of preassembled display panels, each of said display panels removably carried in one of said grid openings, each of said display panels including:

a board having spaced apart front and rear faces and peripheral edges, a plurality of trim strips, each of said trim strips adhered to one of said board edges and including an outer leg extending generally parallel to said board edge and a lip extending inwardly from the forward edge of said outer leg and overlying the perimeter of the front face of said board, said trim strips lying adjacent the forwardly extending legs of said frame members defining the grid opening in which the display panel is installed, and a plurality of hook or loop fabric fastener elements each adhered to the rear of the display panel disposed in coengagement with one of said hook or loop fabric fastener elements on a frame connector pad surface to releasably hold the display panel within a grid opening.

2. The grid display of claim 1 wherein said trim strips each further comprise a flange extending inwardly from the rear edge of said outer leg and overlying the perimeter of the rear face of said board.

3. The grid display of claim 2 wherein said display panels further include a transparent pane coextensively overlying the front face of said board and wherein said lips overlie the perimeter of the front face of the pane.

4. The grid display of claim 1 further comprising a plurality of lengths of double-sided adhesive tape disposed between said board edges and said trim strip outer legs.

* * * * *